US008118577B2

(12) United States Patent
Kimata et al.

(10) Patent No.: US 8,118,577 B2
(45) Date of Patent: Feb. 21, 2012

(54) SCROLL COMPRESSOR HAVING OPTIMIZED CYLINDER OIL CIRCULATION RATE OF LUBRICANT

(75) Inventors: Yoshiyuki Kimata, Kiyosu (JP); Yoshiaki Miyamoto, Kiyosu (JP); Hajime Sato, Nagoya (JP); Taichi Tateishi, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 327 days.

(21) Appl. No.: 12/442,890

(22) PCT Filed: Jan. 30, 2007

(86) PCT No.: PCT/JP2007/051448

§ 371 (c)(1), (2), (4) Date: Mar. 25, 2009

(87) PCT Pub. No.: WO2008/093397

PCT Pub. Date: Aug. 7, 2008

(65) Prior Publication Data

US 2010/0074784 A1 Mar. 25, 2010

(51) Int. Cl.
*F04C 18/00* (2006.01)
*F04C 2/00* (2006.01)

(52) U.S. Cl. ..... 418/55.6; 418/55.1; 418/55.2; 418/94

(58) Field of Classification Search ..... 418/55.1–55.6, 418/57, 88, 94

See application file for complete search history.

(56) References Cited

U.S. PATENT DOCUMENTS 5,370,513 A * 12/1994 Fain ..... 418/55.6
5,953,934 A * 9/1999 Makino et al. ..... 62/470

FOREIGN PATENT DOCUMENTS

| | | | |
|---|---|---|---|
| JP | 6-10857 | A | 1/1994 |
| JP | 8-284832 | A | 10/1996 |
| JP | 2002-303281 | A | 10/2002 |
| JP | 2003-161283 | A | 6/2003 |
| JP | 2004-84633 | A | 3/2004 |
| JP | 2005-54745 | A | 3/2005 |
| JP | 2006-177263 | A | 7/2006 |

* cited by examiner

*Primary Examiner* — Theresa Trieu

(74) *Attorney, Agent, or Firm* — Birch, Stewart, Kolasch & Birch, LLP

(57) ABSTRACT

A scroll compressor (CP) in which the cylinder oil circulation rate of lubricant is optimized during the operation to improve the compression efficiency is provided. In the scroll compressor (CP) having a stepped shape, the cylinder oil circulation rate of lubricant taken into the scroll compressor (CP) and circulated together with refrigerant is set to fall within the range from 1% or more to 10% or less.

3 Claims, 7 Drawing Sheets

SCROLL COMPRESSOR HAVING OPTIMIZED CYLINDER OIL CIRCULATION RATE OF LUBRICANT

TECHNICAL FIELD

The present invention relates to scroll compressors used for air conditioners, refrigerators, and the like.

BACKGROUND ART

In scroll compressors, a fixed scroll and an orbiting scroll are arranged with their spiral walls being assembled, and the orbiting scroll is made to orbitally revolve around the fixed scroll to gradually reduce the volume of compression spaces formed between the walls, thereby compressing fluid in the compression spaces. Among such scroll compressors, those that employ scroll members having stepped shapes have been put to practical use because the compression ratio can be increased without increasing the size of the compressors themselves, so as to improve the compression performance. In one such scroll compressor that has been proposed a tip seal is provided along a connection edge that connects, at a step portion, the upper edges having different heights, in order to improve the airtightness between the scrolls to improve the compression performance, and which has a mechanism that prevents the tip seal from being removed from the connection edge. (For example, see Patent Document 1.)

Patent Document 1: Japanese Unexamined Patent Application, Publication No. 2002-303281

DISCLOSURE OF INVENTION

At the step portion of each of the scroll members described above, a minute gap is formed between the fixed scroll and the orbiting scroll to allow the orbiting operation of the orbiting scroll. Therefore, when the volume of the compression spaces is gradually reduced as the compression process proceeds, compressed gas leaks from the high-pressure side to the low-pressure side through the minute gap. Accordingly, the minute gap formed at the step portion causes a reduction in the compression efficiency of the scroll compressor. In particular, when recent high-pressure refrigerant (for example, R410A, $CO_2$, or the like) is used, the difference in pressure between the high-pressure side and the low-pressure side is increased, so that the leakage of compressed gas causes a more significant reduction in efficiency.

From such circumstances, it is demanded that the minute gap at the step portion be sealed with an oil film of lubricant which is taken into and circulated in the scroll compressor when the scroll compressor is operated, to reduce the leakage of compressed gas and improve the compression efficiency.

The present invention has been made in view of the circumstances described above, and an object thereof is to provide a scroll compressor in which the cylinder oil circulation rate of lubricant during the operation is optimized to improve the compression efficiency.

In order to solve the problems described above, the present invention employs the following solutions.

According to the present invention, there is provided a scroll compressor including: a fixed scroll which has a spiral wall formed upright on one side face of an end plate; and an orbiting scroll which has a spiral wall formed upright on one side face of an end plate and which is supported, when the walls are engaged, so as to allow orbital revolving motion thereof while preventing rotation thereof, the one side face of the end plate of at least one of the fixed scroll and the orbiting scroll being provided with a step part formed to be higher at a center portion and lower at an outer end along a spiral of the wall, an upper edge of the wall of the other one of the fixed scroll and the orbiting scroll being divided into a plurality of portions whose height is low at a center portion of a spiral and is high at an outer end of the spiral, to form a stepped shape corresponding to the step part provided on the end plate, in which a cylinder oil circulation rate of lubricant taken into the scroll compressor and circulated together with refrigerant is set to fall within the range from 1% or more to 10% or less.

According to this scroll compressor, the cylinder oil circulation rate of lubricant taken into the compressor and circulated together with refrigerant is set to fall within the range from 1% or more to 10% or less. Therefore, a sufficient amount of lubricant to form an oil film to seal a minute gap at the step part can be provided.

In the above-described scroll compressor, it is preferable that the lubricant be supplied to the vicinity of the step part. With this structure, it is possible to provide a sufficient amount of lubricant for the vicinity of the step part and to form an oil film effective to seal the minute gap.

In the above-described scroll compressor, it is preferable that the lubricant be supplied to the vicinity of the step part located higher in the direction of gravitational force when the fixed scroll and the orbiting scroll are of a horizontal type. With this structure, the lubricant can fall under the influence of the gravitational force to be supplied.

According to the aspect described above, since the cylinder oil circulation rate of lubricant is set to fall within the range from 1% or more to 10% or less, it is possible to provide a sufficient amount of lubricant to form an oil film to seal the minute gap at the step part and to improve the sealing properties of the minute gap at the step part. As a result, a significant advantageous effect can be obtained in that the amount of compressed gas leaking from the minute gap at the step part is reduced, thereby improving the compression efficiency of the scroll compressor having the stepped shape.

EXPLANATION OF REFERENCE SIGNS

1: housing
11: outlet port
12: fixed scroll
12*a*, 13*a*: end plate
12*b*, 13*b*: wall
12*c*, 12*d*, 13*c*, 13*d*: upper edge (tip)
12*e*, 13*e*: connecting edge (tip)
12*f*, 12*g*, 13*f*, 13*g*: bottom face (bottom)
12*h*, 13*h*: connecting wall face (bottom)
13: orbiting scroll
42, 43: step part
51, 51A: oil separator
CP: scroll compressor
C: compression space

BEST MODE FOR CARRYING OUT THE INVENTION

A scroll compressor according to an embodiment of the present invention will be described below with reference to the drawings.

Figure 3:
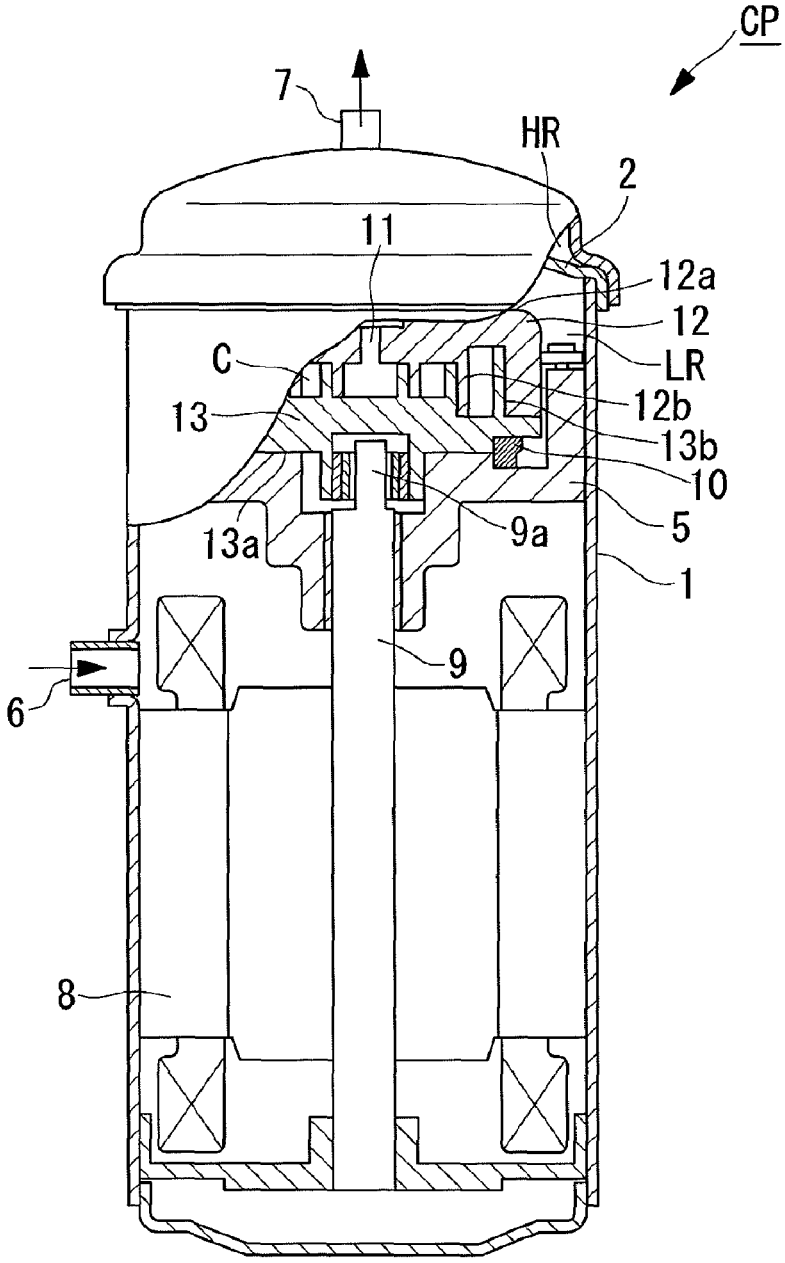
FIG. 3 is a partial cross-sectional view showing an example configuration of the scroll compressor of the present invention.

FIG. 3 is a cross-sectional view showing an example configuration of a scroll compressor CP. In FIG. 3, reference numeral 1 is a hermetically-sealed housing, 2 is a discharge cover which divides the housing 1 into a high-pressure chamber HR and a low-pressure chamber LR, 5 is a frame, 6 is an inlet pipe, 7 is an outlet pipe, 8 is a motor, 9 is a rotary shaft, and 10 is a rotation preventing mechanism. Reference numeral 12 is a fixed scroll, and 13 is an orbiting scroll engaged with the fixed scroll 12.

Figure 4A:
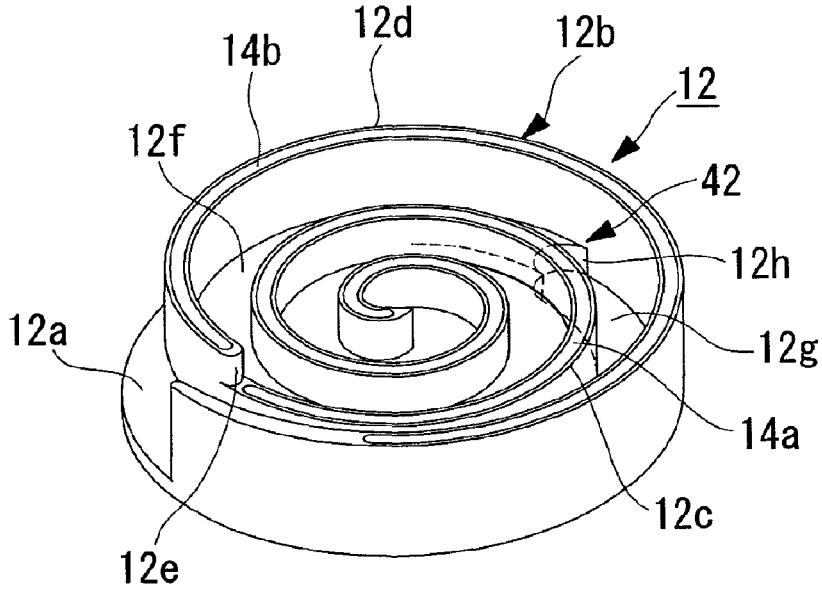
FIG. 4A is a perspective view showing an example configuration of a fixed scroll, placed upside down, of the scroll compressor of the present invention.
Figure 4B:
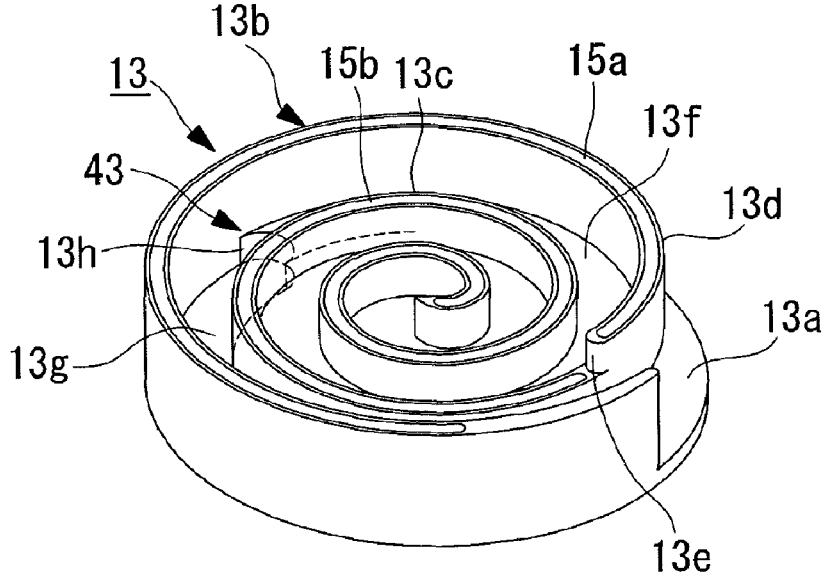
FIG. 4B is a perspective view showing an example configuration of an orbiting scroll of the scroll compressor of the present invention.

The fixed scroll 12 is provided with a spiral wall 12*b* formed upright on one side face of an end plate 12*a*, as shown in FIG. 4A. Similarly to the fixed scroll 12, the orbiting scroll 13 is provided with a spiral wall 13*b* formed upright on one side face of an end plate 13*a*, as shown in FIG. 4B. In particular, the wall 13*b* has substantially the same shape as the wall 12*b* of the fixed scroll 12. The walls 12*b* and 13*b* are engaged and assembled such that the orbiting scroll 13 is eccentric relative to the fixed scroll 12 by the radius of orbital revolution and their phases are shifted from each other by 180 degrees.

In this case, the orbiting scroll 13 performs orbital revolving motion with respect to the fixed scroll 12, due to the actions of the rotation preventing mechanism 10 and an eccentric pin 9*a* that is provided on the top of the rotary shaft 9 driven by the motor 8 and that performs orbiting motion. On the other hand, the fixed scroll 12 is fixed to the housing 1, and an outlet port 11 for compressed fluid is provided at the center of the rear face of the end plate 12*a*.

On the one side face of the end plate 12*a* of the fixed scroll 12, where the wall 12*b* is formed upright, a step part 42 is formed to be higher at a center portion and lower at an outer end along the spiral wall 12*b*. Similarly to the end plate 12*a* of the fixed scroll 12, on the one side face of the end plate 13*a* of the orbiting scroll 13, where the wall 13*b* is formed upright, a step part 43 is formed to be higher at a center portion and lower at an outer end along the spiral wall 13*b*. The step parts 42 and 43 are provided starting at locations that are π (rad) away from the outer ends (inlet sides) of the walls 12*b* and 13*b* toward the inner ends (outlet sides) thereof, respectively, with the centers of the spiral walls 12*b* and 13*b* serving as reference points.

With the step part 42 being formed, a bottom face of the end plate 12*a* is divided into two portions, that is, a shallow bottom face 12*f* provided nearer the center portion and a deep bottom face 12*g* provided nearer the outer end. Between the adjacent bottom faces 12*f* and 12*g*, there is a connecting wall face 12*h* which constitutes the step part 42 and vertically rises to connect the bottom faces 12*f* and 12*g*.

Similarly to the end plate 12*a* described above, with the step part 43 being formed, a bottom face of the end plate 13*a* is divided into two portions, that is, a shallow bottom face 13*f* provided nearer the center portion and a deep bottom face 13*g* provided nearer the outer end. Between the adjacent bottom faces 13*f* and 13*g*, there is a connecting wall face 13*h* which constitutes the step part 43 and vertically rises to connect the bottom faces 13*f* and 13*g*.

The spiral upper edge of the wall 12*b* of the fixed scroll 12 is divided into two portions which are low at the center portion of the spiral and high at the outer end of the spiral, thereby forming a stepped shape corresponding to the step part 43 of the orbiting scroll 13. Similarly to the wall 12*b*, the spiral upper edge of the wall 13*b* of the orbiting scroll 13 is divided into two portions which are low at the center portion of the spiral and high at the outer end of the spiral, thereby forming a stepped shape corresponding to the step part 42 of the fixed scroll 12.

Specifically, the upper edge of the wall 12*b* is divided into two portions, that is, a low-level upper edge 12*c* provided nearer the center portion and a high-level upper edge 12*d* provided nearer the outer end. Between the adjacent upper edges 12*c* and 12*d*, there is a connecting edge 12*e* which connects them and is perpendicular to the orbit plane. Similarly to the wall 12*b* described above, the upper edge of the wall 13*b* is divided into two portions, that is, a low-level upper edge 13*c* provided nearer the center portion and a high-level upper edge 13*d* provided nearer the outer end. Between the adjacent upper edges 13*c* and 13*d*, there is a connecting edge 13*e* which connects them and is perpendicular to the orbit plane.

When the wall 12*b* is viewed from the orbiting scroll 13, the connecting edge 12*e* has a semicircular shape which is smoothly connected to both inner and outer side faces of the wall 12*b* and whose diameter is the same as the thickness of the wall 12*b*. Similarly to the connecting edge 12*e*, the connecting edge 13*e* has a semicircular shape which is smoothly connected to both inner and outer side faces of the wall 13*b* and whose diameter is the same as the thickness of the wall 13*b*.

When the end plate 12*a* is viewed from the direction of an orbit axis, the connecting wall face 12*h* has an are that matches an envelope curve traced by the connecting edge 13*e* during the orbit of the orbiting scroll. Similarly to the connecting wall face 12*h*, the connecting wall face 13*h* has an arc that matches an envelope curve traced by the connecting edge 12*e*.

Tip seals 14*a* and 14*b* which are separated from each other in the vicinity of the connecting edge 12*e* are respectively provided on the upper edges 12*c* and 12*d* of the wall 12*b* of the fixed scroll 12. Similarly, tip seals 15*b* and 15*a* which are separated from each other in the vicinity of the connecting edge 13*e* are respectively provided on the upper edges 13*c* and 13*d* of the wall 13*b* of the orbiting scroll 13. Those tip seals are used to seal tip seal gaps formed between the upper edges (tips) and the bottom faces (bottoms), between the orbiting scroll 13 and the fixed scroll 12, thereby minimizing the leakage of compressed gas fluid.

In other words, when the fixed scroll 12 and the orbiting scroll 13 are assembled, the tip seal 15*b* provided on the low-level upper edge 13*c* is brought into contact with the shallow bottom face 12*f*, and the tip seal 15*a* provided on the high-level upper edge 13*d* is brought into contact with the deep bottom face 12*g*. At the same time, the tip seal 14*a* provided on the low-level upper edge 12*c* is brought into contact with the shallow bottom face 13*f* and the tip seal 14*b* provided on the high-level upper edge 12*d* is brought into contact with the deep bottom face 13*g*. As a result, between the scrolls 12 and 13, the compression spaces C are defined and formed by the end plates 12*a* and 13*a*, which face each other, and by the walls 12*b* and 13*b*. FIG. 4A shows the fixed scroll 12 placed upside down in order to show the stepped shape of the fixed scroll 12.

Figure 5:
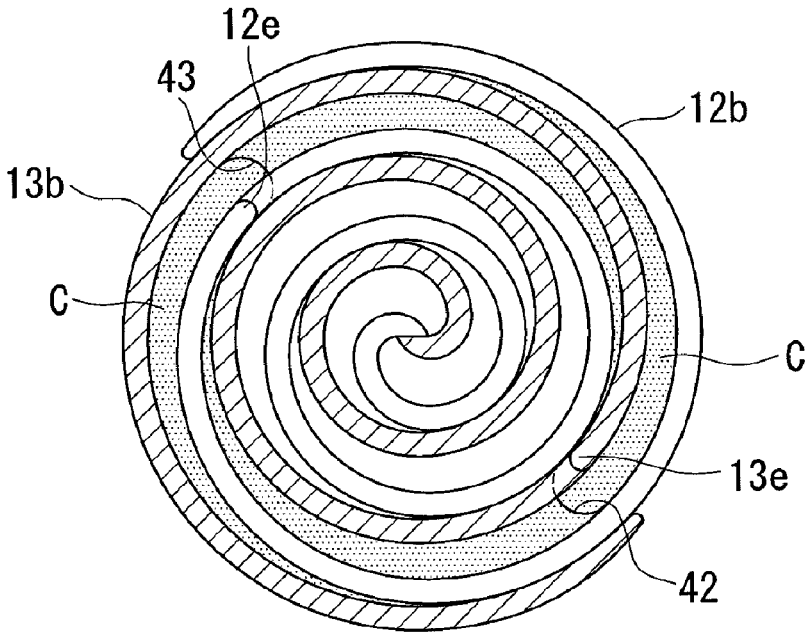
FIG. 5 is a cross-sectional view showing a state where the fixed scroll and the orbiting scroll are assembled to form compression spaces and are about to start compression.

FIG. 5 shows a state where the fixed scroll 12 and the orbiting scroll 13 are assembled to form the compression spaces C and are about to start compression. In this compression start state, the outer end of the wall 12*b* is brought into contact with the outer side face of the wall 13*b*, the outer end of the wall 13*b* is brought into contact with the outer side face of the wall 12*b*, fluid to be compressed is sealed between the end plates 12*a* and 13*a* and between the walls 12*b* and 13*b*, and the two compression spaces C, each having the maximum volume, are formed at locations that face each other across the center of the scroll compression mechanism. Although the connecting edge 12*e* and the connecting wall face 13*h*, and the connecting edge 13*e* and the connecting wall face 12*h* are brought into contact with each other in a slidable manner at this time, they are immediately separated from each other by the orbiting operation of the orbiting scroll 13.

In the scroll compressor CP having the above-described stepped shape, the cylinder oil circulation rate (hereinafter also referred to as "OC %") of lubricant taken into the scroll compressor CP and circulated together with refrigerant is set to fall within the range from 1% or more to 10% or less. The lubricant is supplied to each sliding part in the scroll compressor CP for lubrication, and at least part of the lubricant is converted into mist lubricant and compressed together with gas refrigerant. Therefore, the mist lubricant flows out from the scroll compression mechanism together with the gas refrigerant. In order to collect the lubricant, an oil separator 51 is provided in a refrigerant circuit 50 shown in FIG. 2, for example.

When the lubricant is supplied at the above-mentioned cylinder oil circulation rate, an oil rich state is produced where a larger amount of lubricant than that in a conventional technology is contained, thereby forming good oil films that are excellent in sealing minute gaps at the step parts 42 and 43. Therefore, the minute gaps can be sealed with the oil films, preventing a reduction in the efficiency of the scroll compressor CP caused by the leakage of compressed high-pressure gas from the step parts 42 and 43.

Figure 1:
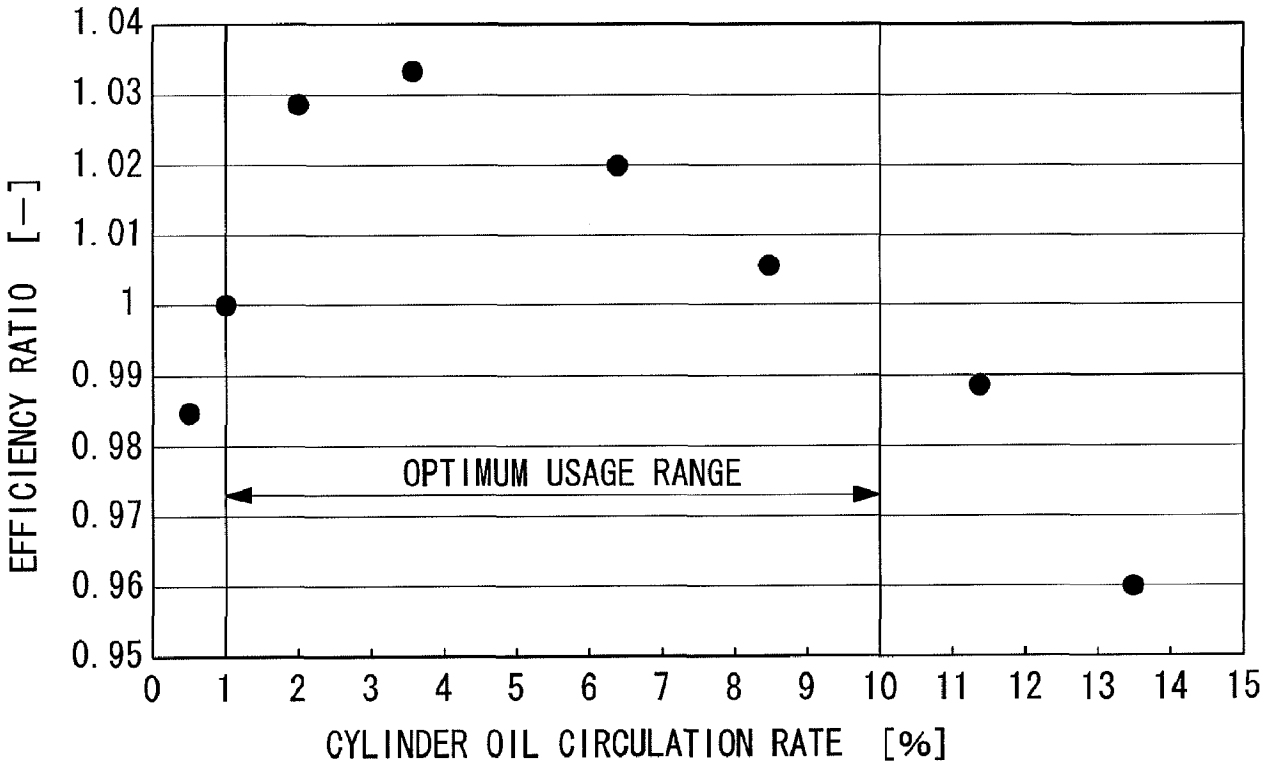
FIG. 1 is a graph of experimental results, showing how the efficiency of a scroll compressor according to an embodiment of the present invention changes when a cylinder oil circulation rate (%) is changed.

FIG. 1 is a graph of experimental results, showing how the efficiency of the scroll compressor CP changes when the cylinder oil circulation rate (%) is changed. In the graph, the horizontal axis indicates the cylinder oil circulation rate and the vertical axis indicates the efficiency ratio. The efficiency is improved when the efficiency ratio is increased to 1 or more. The efficiency ratio used in this case is calculated by using, as a reference (denominator), the efficiency of a conventional scroll compressor that has an identical volume but does not employ the stepped shape, and using the efficiency obtained as a result of each experiment as a numerator.

From the experimental results, it is found that the efficiency ratio is 1 or more when the cylinder oil circulation rate falls within the range from 1% to 10%. Specifically, when the cylinder oil circulation rate falls within the range from 1% to about 3.5%, the efficiency ratio is increased as the cylinder oil circulation rate is increased. When the cylinder oil circulation rate is increased to as high as about 3.5% or more, the efficiency ratio tends to be reduced. When the cylinder oil circulation rate is 10%, the efficiency ratio returns to 1. Therefore, it is preferable that the cylinder oil circulation rate fall within an optimum usage range of 1% or more to 10% or less. It is more preferable that the cylinder oil circulation rate fall within a range of 1% or more to 3.5% or less, where the efficiency can be improved with the minimum circulation amount.

Figure 2A:
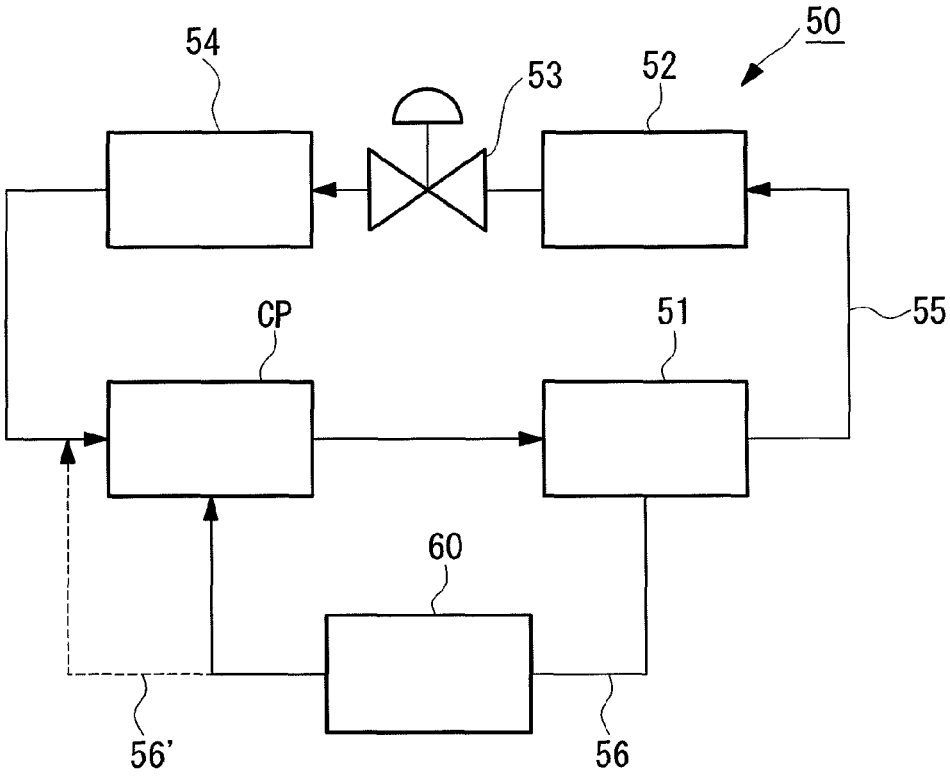
FIG. 2A is a circuit diagram of a refrigeration cycle including the scroll compressor of the present invention, showing an example configuration that includes an external oil separator.
Figure 2B:
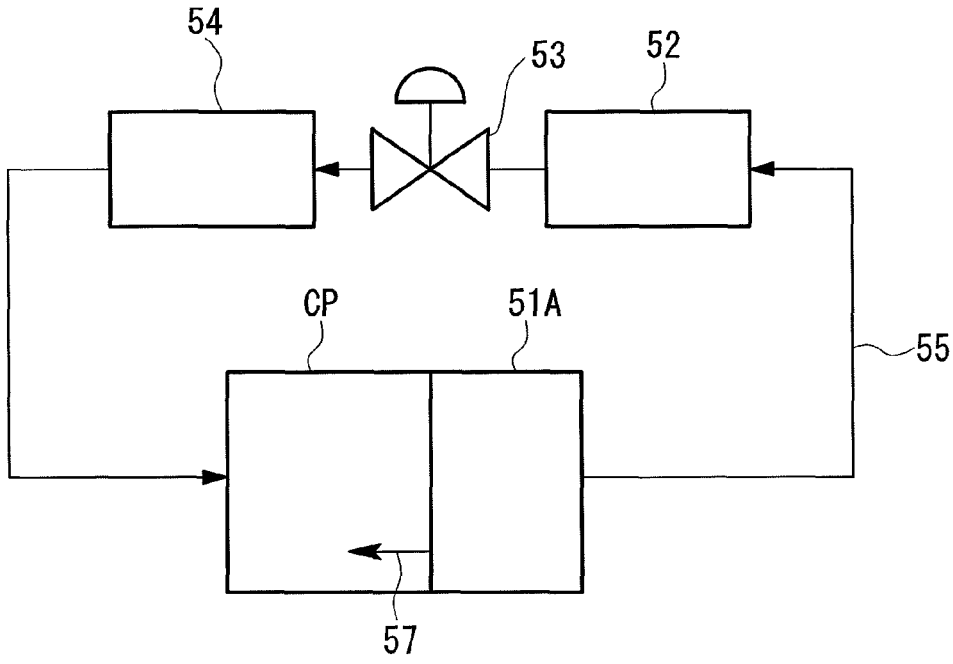
FIG. 2B is a circuit diagram of a refrigeration cycle including the scroll compressor of the present invention, showing an example configuration that includes a built-in oil separator.

In a refrigerant circuit diagram of a refrigeration cycle shown in FIG. 2A, reference numeral 51 in the figure is the oil separator, 52 is a condenser, 53 is a throttling mechanism, and 54 is an evaporator. High-temperature and high-pressure gas refrigerant discharged from the scroll compressor CP circulates through a refrigerant pipe 55 to be condensed and evaporated, thereby undergoing repeated changes in state. In FIG. 2A, reference numeral 60 is a flow-rate adjustment device provided on a lubricant supply pipe 56 to adjust the amount of lubricant to be returned from the oil separator 51 to the scroll compressor CP.

In the refrigerant circuit 50, gas refrigerant supplied to the condenser 52 exchanges heat with surrounding air or the like to radiate heat, and liquid refrigerant supplied to the evaporator 54 exchanges heat with surrounding air or the like to absorb heat.

In the refrigerant circuit 50, the oil separator 51 is externally attached at a location near the outlet side of the scroll compressor CP and upstream of the condenser 52. Instead of the oil separator 51, which is externally attached, it is possible to use a built-in oil separator 51A that is built into the scroll compressor CP in the flow path at the outlet side of the scroll compressor CP, as in a refrigerant circuit 50A shown in FIG. 2B, for example.

Each of the above-described oil separators 51 and 51A separates mist lubricant from gas refrigerant discharged from the scroll compressor CP, stores the lubricant, and supplies the lubricant in a necessary amount controlled, for example, by the flow-rate adjustment device 60 to an appropriate portion of the scroll compressor CP by using a lubricant pump mechanism or the like (not shown).

In the case of using the external oil separator 51 shown in FIG. 2A, it is preferable to supply the lubricant to the inside of the housing 1 of the scroll compressor CP or to an intake pipe of the refrigerant pipe 55 (low-pressure pipe upstream of the compressor). In this case, the oil separator 51 and the housing 1 of the scroll compressor CP are coupled by the lubricant supply pipe 56, and the oil separator 51 and the intake pipe are coupled by a lubricant supply pipe 56'. In contrast, in the case of using the built-in oil separator 51A shown in FIG. 2B, it is preferable to directly supply the lubricant not only to an appropriate portion inside the housing 1 but also to the scroll compression mechanism, when closed, via lubricant supply passages 57 or the like. When the lubricant is supplied particularly to the vicinity of the step parts 42 and 43, an abundant amount of lubricant can be provided near the minute gaps, thereby reliably forming good oil films having excellent sealing properties.

Figure 6A:
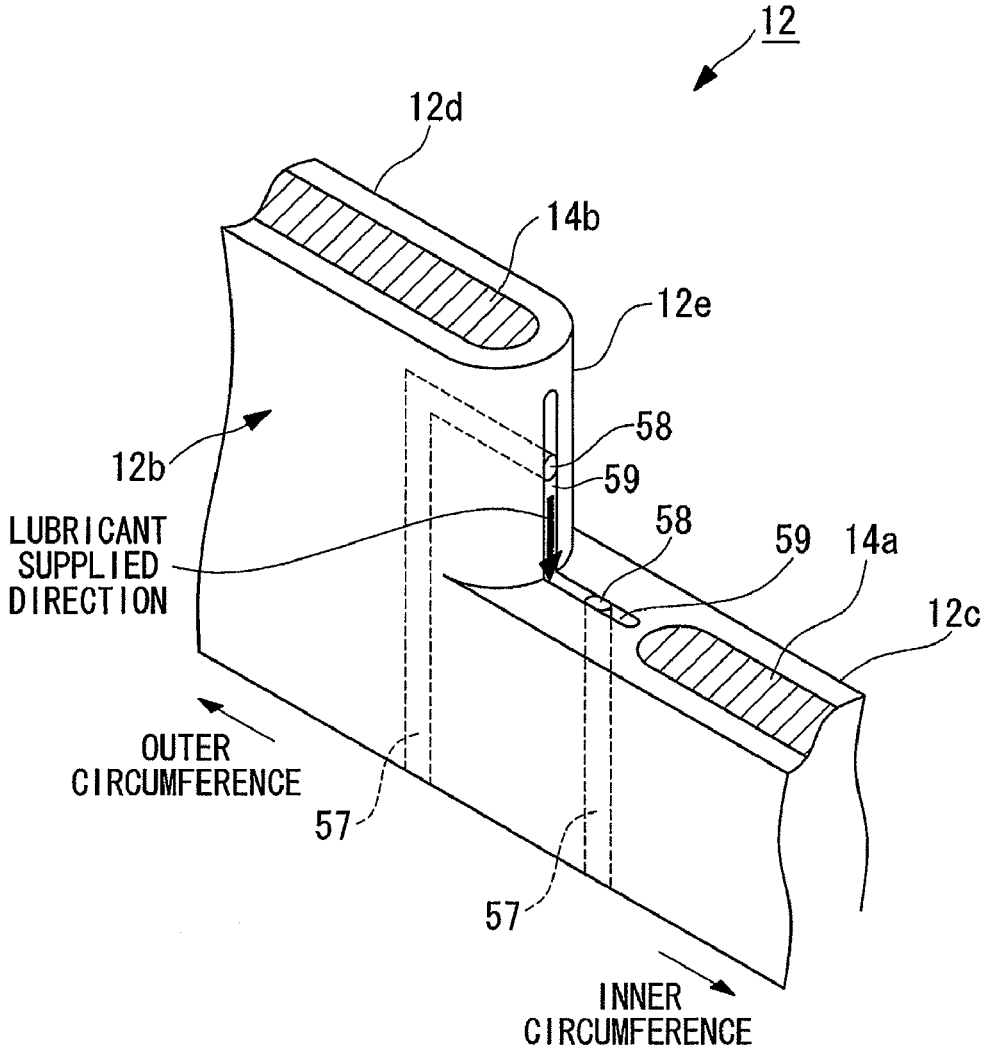
FIG. 6 is a main-portion perspective view showing an example configuration where lubricant is supplied to the vicinity of a step part of the present invention.
Figure 6B:
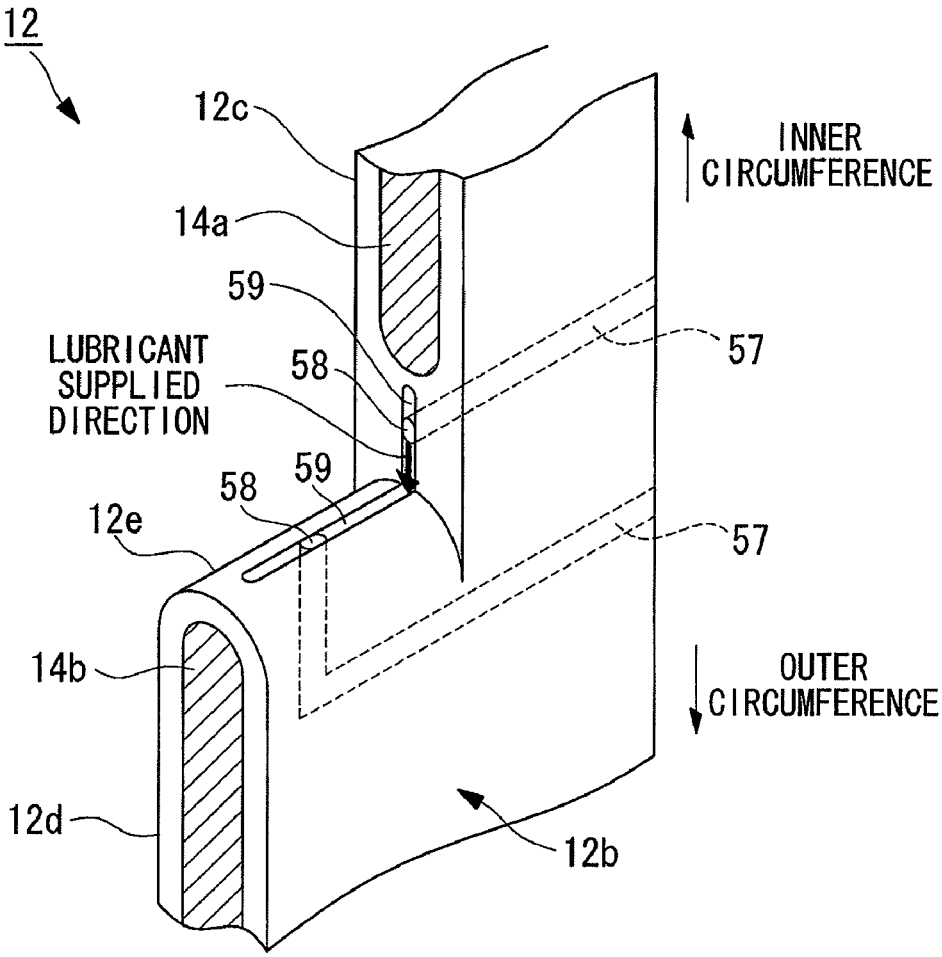

A specific example where lubricant is supplied to the vicinities of the step parts 42 and 43 will be briefly described with reference to FIG. 6. In the example shown in FIG. 6, the lubricant supply passages 57 are formed inside the wall 12*b* of the fixed scroll 12 to supply lubricant to the vicinity of the step part. In this case, the lubricant supply passages 57 are communicated with outlet holes 58 which are opened to the connecting edge 12*e* and to the low-level upper edge 12*c* connected to the connecting edge 12*e*, to let lubricant flow out from both of the outlet holes 58. In FIG. 6, reference numeral 59 is a minute groove which holds the lubricant.

With this structure, it is possible to form the step part and to supply lubricant to a portion where the tip seals 14*a* and 14*b* are not provided, to form an oil film on the minute gap. Therefore, the leakage of compressed gas can be prevented to improve the efficiency.

When the scroll compressor CP is of a horizontal type, if lubricant is supplied to the vicinity of one step part, located higher in the direction of gravitational force, of the step parts 42 and 43, a sufficient amount of lubricant can be provided for the other step part, located lower in the direction of gravitational force, because the lubricant falls due to the gravitational force. Therefore, oil films that are effective in sealing the minute gaps can be efficiently formed in both step parts, located higher and lower in the direction of gravitational force, and the oil films can prevent leakage, thus improving the efficiency of the scroll compressor CP.

The above-described cylinder oil circulation rate may be set through lubricant flow-rate control performed by using, for example, the flow-rate adjustment device 60, to be described below.

As shown in FIG. 2A, the flow-rate adjustment device 60 is located between the scroll compressor CP, which compresses and discharges refrigerant, and the oil separator 51, which separates mist lubricant included in the refrigerant discharged from the scroll compressor CP. The flow-rate adjustment device 60 has a function of increasing a flow rate of lubricant to be returned from the oil separator 51 to the scroll compressor CP as a refrigerant-circulation-amount parameter is increased. The refrigerant-circulation-amount parameter is a control value expressed by the product of the rotational speed of the scroll compressor CP and the pressure of refrigerant measured at the inlet of the scroll compressor CP.

The flow rate of lubricant means the amount of lubricant to be returned to the scroll compressor CP per unit time or the amount of lubricant to be returned to the scroll compressor CP within a predetermined period of time. When lubricant flows in a continuous manner, either the amount of lubricant to be returned to the scroll compressor CP per unit time or the amount of lubricant to be returned to the scroll compressor CP within a predetermined period of time may be used for comparison of the amount of lubricant to be returned to the scroll compressor CP.

On the other hand, when an on-off valve (not shown) provided in a lubricant flow path is used, for example, and the average amount of lubricant to be returned to the scroll compressor CP within a predetermined period of time is changed by changing a valve open time within the predetermined period of time, lubricant flows intermittently. In this case, for comparison of the amount of lubricant to be returned to the scroll compressor CP, it is more appropriate to use the amount of lubricant to be returned to the scroll compressor CP within a predetermined period of time, than the amount of lubricant to be returned to the scroll compressor CP per unit time.

According to the above-described scroll compressor CP of the present invention, since the cylinder oil circulation rate (OC %) of lubricant is set to fall within the range from 1% or more to 10% or less, it is possible to provide a sufficient amount of lubricant to form oil films to seal the minute gaps at the step parts 42 and 43, and to improve the sealing properties of the minute gaps at the step parts 42 and 43. As a result, the amount of compressed gas leaking from the minute gaps at the step parts 42 and 43 can be reduced, thereby improving the compression efficiency of the scroll compressor CP having the stepped shape.

The present invention is not limited to the embodiment described above. The present invention can be applied to any types of compressors, such as horizontal compressors, vertical compressors, hermetic type compressors, and open type compressors, as long as the compressors have a scroll compression mechanism having a stepped shape. Modifications can be appropriately made without departing from the scope of the present invention.

The invention claimed is:

1. A scroll compressor comprising: a fixed scroll which has a spiral wall formed upright on one side face of an end plate; and an orbiting scroll which has a spiral wall formed upright on one side face of an end plate and which is supported, when the walls are engaged, so as to allow orbital revolving motion thereof while preventing rotation thereof, the one side face of the end plate of at least one of the fixed scroll and the orbiting scroll being provided with a step part formed to be higher at a center portion and lower at an outer end along a spiral of the wall, an upper edge of the wall of the other one of the fixed scroll and the orbiting scroll being divided into a plurality of portions whose height is low at a center portion of a spiral and is high at an outer end of the spiral, to form a stepped shape corresponding to the step part provided on the end plate, wherein a cylinder oil circulation rate of lubricant taken into the scroll compressor and circulated together with refrigerant is set to fall within the range from 1% or more to 10% or less based on a parameter determined by a product of a rotational speed of the scroll compressor and a pressure of refrigerant measured at an inlet of the scroll compressor.

2. A scroll compressor according to claim 1, wherein the lubricant is supplied to a vicinity of the step part.

3. A scroll compressor according to claim 2, wherein the lubricant is supplied to the vicinity of the step part located higher in a direction of gravitational force when the orbiting scroll and the fixed scroll are of a horizontal type.

* * * * *